US007006602B2

(12) United States Patent
Kendall

(10) Patent No.: US 7,006,602 B2
(45) Date of Patent: Feb. 28, 2006

(54) X-RAY TUBE ENERGY-ABSORBING APPARATUS

(75) Inventor: Charles B. Kendall, Brookfield, WI (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/605,363

(22) Filed: Sep. 25, 2003

(65) Prior Publication Data

US 2005/0069087 A1 Mar. 31, 2005

(51) Int. Cl.
*H01J 35/00* (2006.01)

(52) U.S. Cl. ..... 378/125; 379/119

(58) Field of Classification Search ..... 378/119–144; 313/50, 269; 181/207, 209
See application file for complete search history.

(56) References Cited

U.S. PATENT DOCUMENTS 4,995,065 A * 2/1991 Janouin et al. ..... 378/130
5,159,618 A * 10/1992 Blake ..... 378/139
5,265,147 A * 11/1993 Kim et al. ..... 378/131
5,588,035 A * 12/1996 Christean et al. ..... 378/132
6,487,273 B1 * 11/2002 Takenaka et al. ..... 378/142
6,490,340 B1 * 12/2002 Artig et al. ..... 378/121

* cited by examiner

*Primary Examiner*—David V. Bruce
*Assistant Examiner*—Hoon Song
(74) *Attorney, Agent, or Firm*—Peter J. Vogel

(57) ABSTRACT

An energy-absorbing device (78) for an imaging tube (18) includes an energy-absorbing body (82). The energy-absorbing body (82) is fluidically coupled to a housing (60) of the imaging tube (18) and absorbs the kinetic energy generated within the imaging tube (18). The kinetic energy may be generated from the separation of material fragments from a rotating target (74) within the housing (60).

29 Claims, 3 Drawing Sheets

X-RAY TUBE ENERGY-ABSORBING APPARATUS

BACKGROUND OF INVENTION

The present invention relates generally to x-ray tube components and systems. More particularly, the present invention relates to an apparatus for absorbing kinetic energy within an x-ray tube before absorption by an x-ray tube housing.

An x-ray system typically includes an x-ray tube that is used in the imaging process for the generation of x-rays. The x-ray tube generates x-rays across a vacuum gap between a cathode and a rotating anode. In order to generate the x-rays, a large voltage potential is created across the vacuum gap, which allows electrons to be emitted, in the form of an electron beam. The electron beam is emitted from the cathode to a target on the anode. The target is often in the form of a cap that is brazed onto the anode and is formed of a graphite material.

In releasing of the electrons, a filament contained within the cathode is heated to incandescence by passing an electric current therein. The electrons are accelerated by the high voltage potential and impinge on the target, where they are abruptly slowed down to emit x-rays. The high voltage potential produces a large amount of heat within the x-ray tube, especially within the anode.

The cathode and the anode reside within a vacuum vessel, which is sometimes referred to as an insert or frame. The frame is typically enclosed in a housing filled with circulating, cooling fluid, such as a dielectric oil. The cooling fluid often serves two purposes: cooling the vacuum vessel, and providing high voltage insulation between the anode and the cathode.

Over time, through use of the x-ray system and as a result of material or manufacturing imperfections in the target, material fragments of the target can break away or separate from the anode. The material fragments can be released radially from the target cap and subsequently collide with the frame.

Kinetic energy of the target fragments and the abrupt collision of the fragments with the frame can cause generation of energy waves in the cooling fluid. The cooling fluid absorbs some of the kinetic energy. The remaining kinetic energy is transmitted to the housing, where a substantial portion of the remaining energy is absorbed. The strength of the remaining kinetic energy can be sufficient to crack the housing, allowing oil to leak therethrough. Leakage of the oil can result in the malfunctioning of the x-ray tube. Also, the oil may come in contact with and negatively effect performance of other sensitive x-ray system equipment. The oil may even be undesirably released on a patient being examined.

Thus, there exists a need for an apparatus that minimizes the transfer of kinetic energy, generated from the separation of material fragments of an x-ray tube rotating target, to an x-ray tube housing that is capable of withstanding the environment within an x-ray tube.

SUMMARY OF INVENTION

The present invention provides a kinetic energy-absorbing device for an imaging tube. The energy-absorbing device includes an energy-absorbing body, which is fluidically coupled to a housing of the imaging tube. The kinetic energy can be generated from the separation of material fragments from a rotating target within the housing.

The embodiments of the present invention provide several advantages. The invention can prevent cracking in the x-ray tube housing and thus prevent coolant leakages and the disadvantages associated therewith. The energy-absorbing device absorbs the kinetic energy, which is generated within the x-ray tube, before it can be absorbed by the housing.

Also the energy-absorbing device positioned within the x-ray tube housing can aid in the control of pressure exertions experienced within an x-ray tube. Thus, the invention can protect the structural integrity of the housing and, as a result, increase the life of the x-ray tube.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein:

FIG. 3 is a cross-sectional view of an x-ray tube assembly incorporating use of the imaging tube energy-absorbing assembly in accordance with an embodiment of the present invention; and.

DETAILED DESCRIPTION

While the present invention is described with respect to an apparatus for minimizing the transfer of kinetic energy to an x-ray tube housing, the following apparatus is capable of being adapted for various purposes and is not limited to the following applications: computed tomography (CT) systems, radiotherapy systems, x-ray imaging systems, and other applications known in the art. The present invention may be applied to x-ray tubes, CT tubes, and other imaging tubes known in the art.

In the following description, various operating parameters and components are described for one constructed embodiment. These specific parameters and components are included as examples and are not meant to be limiting.

Also, although the present invention is primarily described with respect to absorbing kinetic energy generated from the separation of material fragments from a rotating target of an x-ray tube, the present invention may be used to absorb kinetic energy generated from other x-ray tube components and the material fragments separated therefrom.

Figure 1:
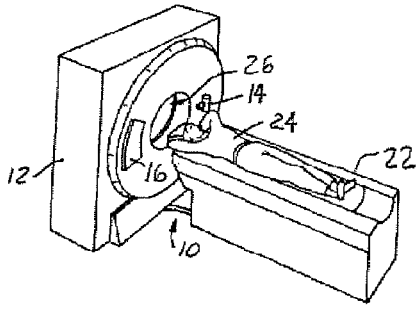
FIG. 1 is a schematic block diagrammatic view of a multi-slice CT imaging system utilizing an imaging tube energy-absorbing assembly in accordance with an embodiment of the present invention.
Figure 2:
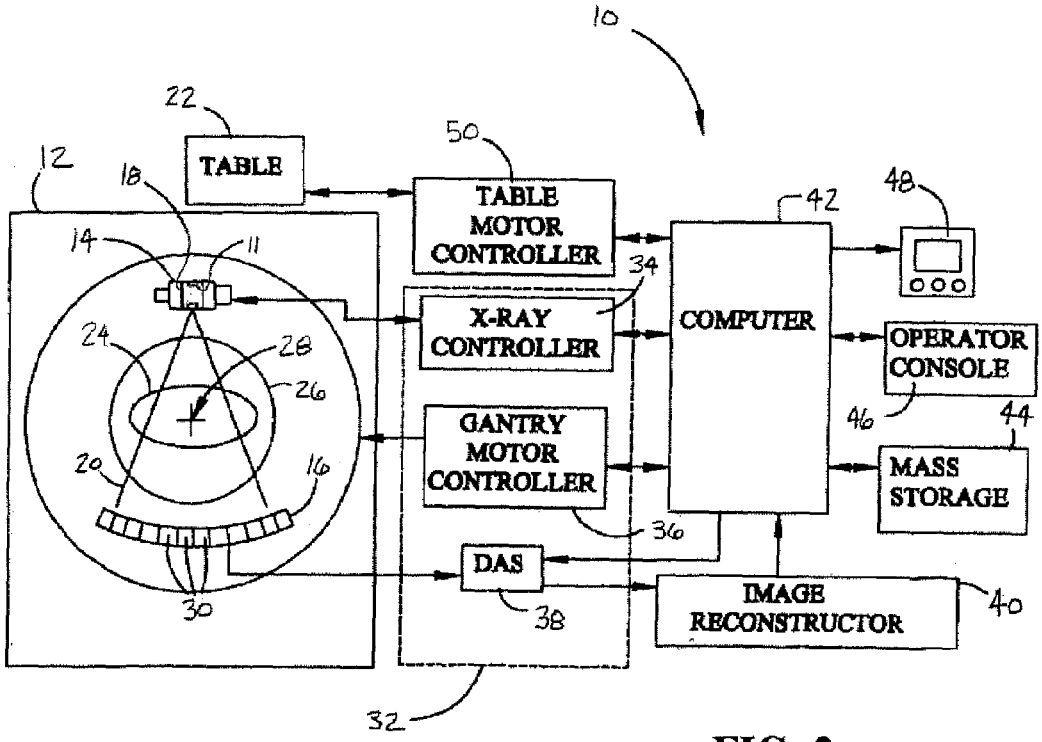
FIG. 2 is a block diagrammatic view of the multi-slice CT imaging system of FIG. 1 having the imaging tube energy-absorbing assembly in accordance with an embodiment of the present invention.

Referring now to FIGS. 1 and 2, perspective and block diagrammatic views of a multi-slice CT imaging system 10 utilizing an imaging tube energy-absorbing assembly 11 in accordance with an embodiment of the present invention is shown. The imaging system 10 includes a gantry 12 that has an x-ray tube assembly 14 and a detector array 16. The x-ray tube assembly 14 has an x-ray generating device or x-ray tube 18. The tube 18 projects a beam of x-rays 20 towards the detector array 16. The tube 18 and the detector array 16 rotate about an operably translatable table 22. The table 22 is translated along a z-axis between the assembly 14 and the detector array 16 to perform a helical scan. The beam 20 after passing through a medical patient 24, within a patient bore 26, is detected at the detector array 16. The detector array 16 upon receiving the beam 20 generates projection data that is used to create a CT image.

The tube 18 and the detector array 16 rotate about a center axis 28. The beam 20 is received by multiple detector elements 30. Each detector element 30 generates an electrical signal corresponding to the intensity of the impinging x-ray beam 20. As the beam 20 passes through the patient 24 the beam 20 is attenuated. Rotation of the gantry 12 and the operation of tube 18 are governed by a control mechanism 32. Control mechanism 32 includes an x-ray controller 34 that provides power and timing signals to the tube 18 and a gantry motor controller 36 that controls the rotational speed and position of the gantry 12. A data acquisition system (DAS) 38 samples analog data, generated from the detector elements 30, and converts the analog data into digital signals for subsequent processing thereof. An image reconstructor 40 receives the sampled and digitized x-ray data from the DAS 38 and performs high-speed image reconstruction to generate the CT image. A main controller or computer 42 stores the CT image in a mass storage device 44.

The computer 42 also receives commands and scanning parameters from an operator via an operator console 46. A display 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in the gantry 12.

The x-ray controller 34, the gantry motor controller 36, the image reconstructor 40, the computer 42, and the table motor controller 50 may be microprocessor-based such as a computer having a central processing unit, memory (RAM and/or ROM), and associated input and output buses. The x-ray controller 34, the gantry motor controller 36, the image reconstructor 40, the computer 42, and the table motor controller 50 may be a portion of a central control unit or may each be stand-alone components as shown.

Figure 3:
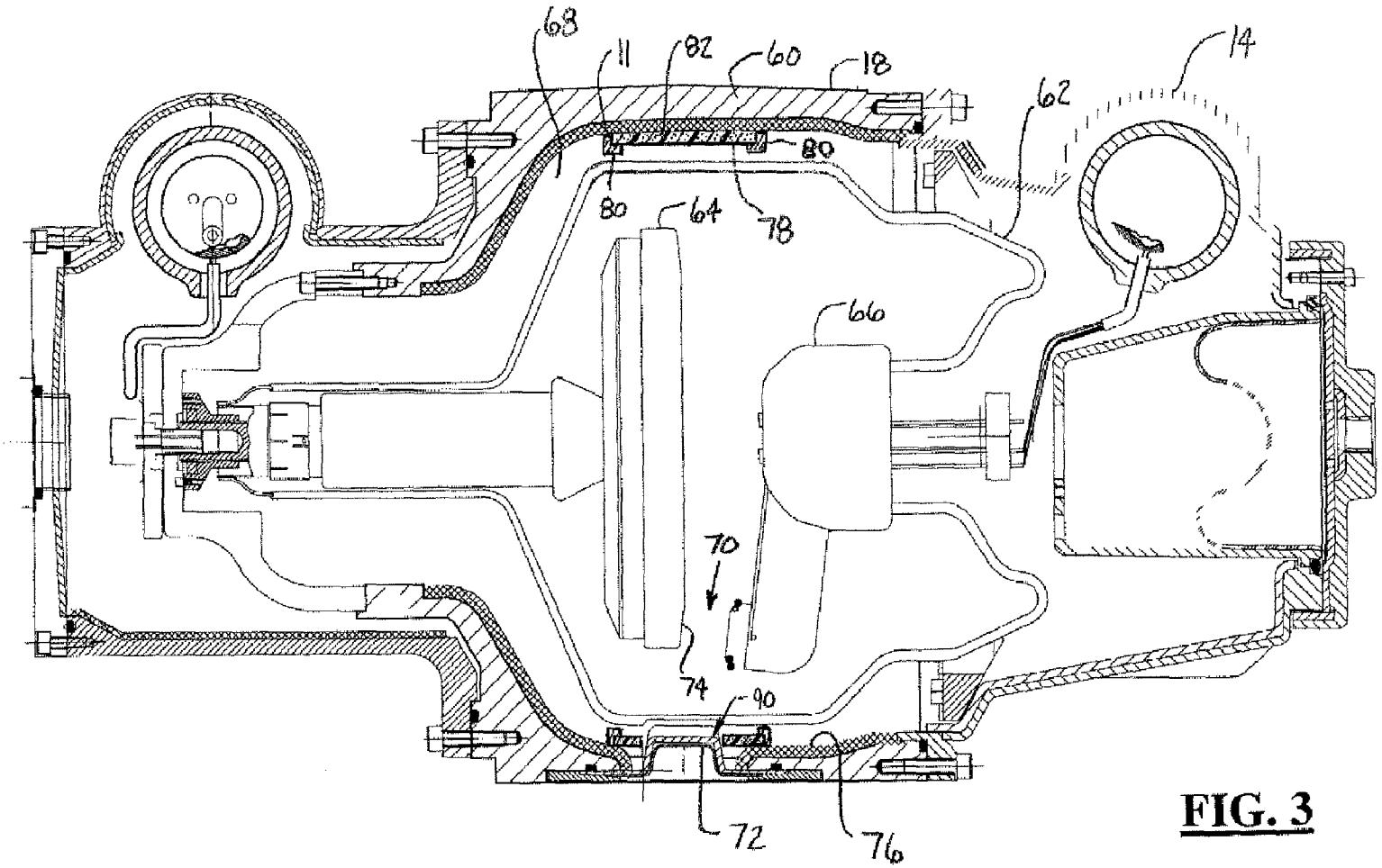

Referring now to FIG. 3, a cross-sectional view of the x-ray tube assembly 14 incorporating use of the imaging tube energy-absorbing assembly 11 in accordance with an embodiment of the present invention is shown. The imaging tube 18 includes an exterior housing 60 that has an insert or frame 62. The frame 62 may be formed from metal and contains a rotating anode 64 and a cathode 66. The frame 62 is surrounded by a coolant 68, which is circulated around the frame 62 and cooled via a pump and a heat exchanger (both of which are not shown). The coolant 68 may be in the form of an insulating dielectric oil. Electrons pass from the cathode 66 to the rotating anode 64 across a vacuum gap 70 where they impinge on the anode 64 and produce x-rays. The x-rays then pass through a window 72 in the housing 60 for scanning purposes.

The rotating anode 64 has a target 74 thereon. The target 74 may be in the form of a target cap and formed of a graphite material. As material fragments of the target 74 separate from the rotating anode 64 and collide with the frame 62, kinetic energy generated therefrom is transferred into the frame 62 and the surrounding coolant 68. The kinetic energy is transferred in the form of energy waves. The kinetic energy is partially absorbed by the coolant 68. A substantial amount of the remaining kinetic energy is absorbed by the energy-absorbing assembly 11, such that little to zero kinetic energy is transferred into the housing 60.

The energy-absorbing assembly 11 also stabilizes and reduces pressure exertions on the housing 60, which can occur from temperature fluctuations of the components and materials contained within the x-ray tube 18. For example, as the x-ray tube 18 is operated, temperatures within the x-ray tube 18 increase and can cause expansion of the internal components and materials, such as the coolant 68. The expansion of the components and materials can exert pressure on the housing 60. Since the energy-absorbing device 11 is compressible, it aids in the stabilization of the increase in pressure by, in effect, increasing the volume within the housing 60. The increase in volume decreases the pressure on the inner walls or surfaces, such as inner surface 76, of the housing 60.

The energy-absorbing assembly 11 is directly coupled to and within the housing 60 and is fluidically coupled to the rotating target 74, via the frame 62 and the coolant 68. The energy-absorbing assembly 11 is coupled to the inner surface 76 of the housing 60. The energy-absorbing assembly 11 includes an energy-absorbing device 78 and a pair of energy absorbing device couplers 80.

Figure 4:
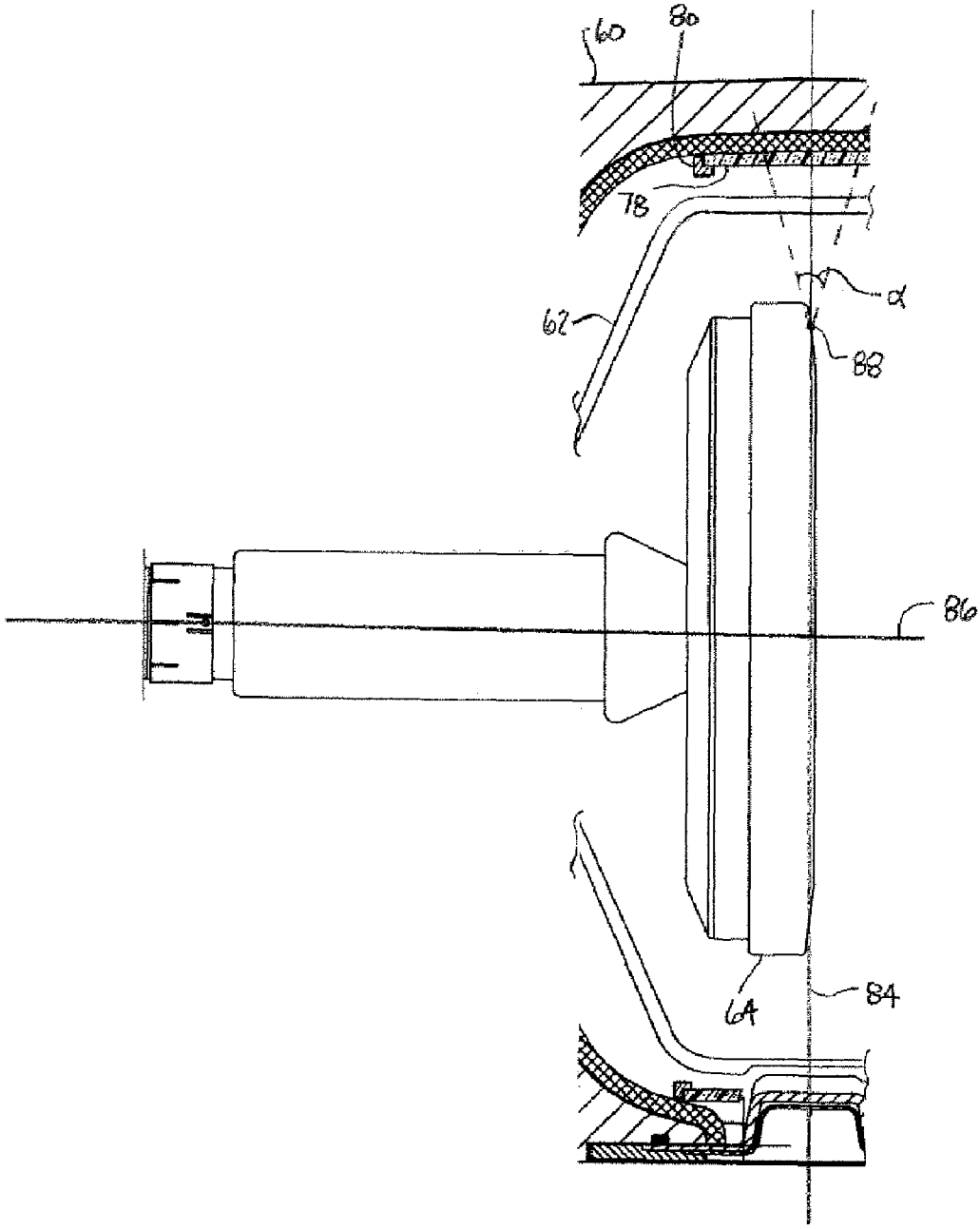
FIG. 4 is a close-up sectional view of a rotating anode and the imaging tube energy-absorbing assembly in accordance with an embodiment of the present invention.

The energy-absorbing device 78 includes an energy-absorbing body 82. The energy-absorbing device 78 is oriented to receive the energy waves generated from the separation of the material fragments. In one embodiment of the present invention, the energy-absorbing device 78 is oriented to at least receive energy waves emitted within an emission range. The emission range is best seen in FIG. 4 and is represented by angle $\alpha$. The energy-absorbing device 78 may receive energy waves outside the emission range $\alpha$. The emission range $\alpha$ covers a span of approximately $\pm 30°$ from a perpendicular axis 84, which extends perpendicular from a center axis of rotation 86 of the rotating anode 64. The emission range $\alpha$ has a vertex 88 that is approximately in the center of the target 74.

Referring again to FIG. 3, the energy-absorbing device 78 may be in the form of a toroidally shaped body, as shown. The energy-absorbing device 78 may also have an opening 90 for the transmission of x-rays therethrough, also as shown. Although a single energy-absorbing device is shown, any number of energy-absorbing devices may be utilized. The energy-absorbing device 78 may be of any shape or style, and may be in various locations within the imaging tube 18.

The energy-absorbing device 78 may be formed of a foam, a closed cell foam, a polyolefin foam, a olefin foam, a polymer, a polyolefin plastic, some other material having similar properties, or a combination thereof. In an embodiment of the present invention, the energy-absorbing device 78 is formed of a closed cell polyolefin foam having an outer skin.

Although the energy-absorbing device 78 is shown as being coupled to the inner surface 76 via the pair of energy-absorbing device couplers 80, the energy-absorbing device 78 may be coupled to the housing 60 using various techniques known in the art. The techniques may include bonding, adhering, fastening, brazing, welding, spot welding, some other technique known in the art, or a combination thereof. The couplers 80 may be in the form of brackets, as shown, or may be in some other form. The couplers 80 may be in the form of fasteners or may be in the form of a cover that resides over the energy-absorbing device 78. The couplers 80 may be separate from or integrally formed as part of the housing 60.

The present invention provides an apparatus for the absorption of kinetic energy within an x-ray tube. The apparatus is capable of withstanding the environment within the x-ray tube. The apparatus absorbs energy generated from the separation of material fragments from a rotating anode. The present invention also stabilizes and minimizes pressure exertions on the housing of an x-ray tube. The present invention is inexpensive to manufacture and easy to implement within an x-ray tube.

The above-described apparatus and method, to one skilled in the art, is capable of being adapted for various applications and systems known in the art. The above-described invention can also be varied without deviating from the true scope of the invention.

What is claimed is:

1. An energy-absorbing device for an imaging tube having a housing, said device comprising an energy-absorbing body mechanically coupled to said housing and adapted to absorb and sustain kinetic energy directed at said housing and generated from the radial release of at least one material fragment within the imaging tube, and energy-absorbing body resilient to cracking and preventing cracking of said housing.

2. A device as in claim 1 wherein said energy-absorbing body is directly coupled to said housing and receives and absorbs non-acoustical kinetic energy generated from the radial release of said at least one material fragment from a rotating anode.

3. A device as in claim 1 wherein said energy-absorbing device is directly coupled to said housing and receives kinetic energy passed through a fluid between said energy-absorbing device and a rotating target and generated from the radial release of said at least one material fragment from said rotating target.

4. A device as in claim 1 wherein said energy-absorbing device is adapted to absorb pressure exertions on said housing.

5. An energy-absorbing device as in claim 1 wherein said energy-absorbing body is in a solidified state during operation of said imaging tube.

6. An energy-absorbing device as in claim 1 wherein said energy-absorbing body is configured to continuously absorb said kinetic energy.

7. An imaging tube comprising:

a housing;

a rotating target coupled within said housing and generating at least one kinetic energy wave from the radial release of at least one material fragment within said housing; and at least one energy-absorbing device mechanically coupled to said housing, separated from an imaging tube frame, and proximate said rotating target, said at least one energy-absorbing device resilient to cracking and adapted to absorb and sustain energy within said at least one kinetic energy wave.

8. An imaging tube as in claim 7 further comprising said imaging tube frame coupled between said rotating target and said housing and containing at least a portion of said at least one kinetic energy wave, said at least one energy-absorbing device absorbing energy within said portion.

9. An imaging tube as in claim 7 further comprising a cooling material containing at least a portion of said at least one kinetic energy wave, said at least one energy-absorbing device absorbing energy within said portion.

10. An imaging tube as in claim 7 wherein said at least one energy-absorbing device is within said housing.

11. An imaging tube as in claim 7 wherein said at least one energy-absorbing device is mechanically coupled to said housing and between said rotating target and said housing.

12. An imaging tube as in claim 7 wherein said at least one energy-absorbing device is toroidal in shape.

13. An imaging tube as in claim 7 wherein said at least one energy-absorbing device is directly coupled to an inner surface of said housing.

14. An imaging tube as in claim 7 wherein said at least one energy-absorbing device is formed of a material selected from at least one of a foam, a closed cell foam, a polyolefin foam, a olefin foam, a polymer, and a polyolefin plastic.

15. An imaging tube as in claim 7 wherein said at least one energy-absorbing device is oriented to receive said at least one kinetic energy wave generated from the separation of material fragments from said rotating target.

16. An imaging tube as in claim 7 wherein said at least one energy-absorbing device is oriented to receive energy waves emitted within an emission range that is approximately a ±30° span from a perpendicular axis, which extends perpendicular to a center axis of rotation of said rotating anode.

17. An imaging tube as in claim 7 wherein said at least one energy-absorbing device is coupled to said housing using at least one technique selected from bonding, adhering, fastening, brazing, welding, and spot welding.

18. An imaging tube as in claim 7 further comprising at least one energy-absorbing device coupler coupling said energy-absorbing device to said housing.

19. An imaging tube as in claim 18 wherein said at least one energy-absorbing device coupler is a coupler selected from at least one of a bracket, a fastener, and a cover.

20. An imaging tube as in claim 18 wherein said at least one energy-absorbing device coupler is integrally formed as part of the housing.

21. An imaging tube as in claim 7 wherein said at least one energy-absorbing device comprises an outer skin.

22. An imaging tube as in claim 7 wherein said at least one energy-absorbing device stabilizes and reduces pressure exertions on said housing.

23. An imaging tube as in claim 7 wherein said at least one energy-absorbing device comprises an x-ray opening.

24. An imaging tube as in claim 7 wherein said energy-absorbing device comprises a single non-encasing member.

25. An imaging system having an imaging tube comprising:

a housing;

a rotating target coupled within said housing and generating at least one kinetic energy wave from the radial release of at least one material fragment within said housing; and at least one energy-absorbing device resilient to damage as a result of receiving said at least one kinetic energy wave and mechanically coupled to said housing, proximate said rotating target, and absorbing energy within said at least one kinetic energy wave, which is directed at said housing.

26. A method of absorbing kinetic energy within an imaging tube having a housing comprising:

radially releasing at least one material fragment;

mechanically coupling an energy-absorbing body, which is resilient to damage as a result of receiving said at least one material fragment, to the housing;

orienting said energy-absorbing body to receive said at least one material fragment; and absorbing and sustaining kinetic energy directed at the housing in response to reception of said at least one material fragment.

27. A method as in claim 26 further comprising receiving said kinetic energy passed through a fluid between said energy-absorbing body and a rotating target and generated from the radial release of said at least one material fragment from said rotating target.

28. A method as in claim 26 further comprising absorb pressure exertions on said housing via said energy-absorbing body.

29. A method as in claim 26 wherein absorbing kinetic energy directed at the housing comprises absorbing non-acoustical kinetic energy and acoustical kinetic energy.

* * * * *

UNITED STATES PATENT AND TRADEMARK OFFICE

CERTIFICATE OF CORRECTION

PATENT NO. : 7,006,602 B2
APPLICATION NO. : 10/605363
DATED : February 28, 2006
INVENTOR(S) : Charles B. Kendall It is certified that error appears in the above-identified patent and that said Letters Patent is hereby corrected as shown below:

Column 5, line 21, should read as follows:

-- fragment within the imaging tube, said energy-absorbing --

Signed and Sealed this

Twenty-first Day of November, 2006

JON W. DUDAS
*Director of the United States Patent and Trademark Office*